US007030893B2

(12) United States Patent
Yang

(10) Patent No.: US 7,030,893 B2
(45) Date of Patent: Apr. 18, 2006

(54) METHOD FOR DRIVING FULL-COLOR LED DISPLAY BOARD

(75) Inventor: Ming-Hsiang Yang, Taipei (TW)

(73) Assignee: Neo-Led Technology Co., Ltd., Taoyuan Hsien (TW)

( * ) Notice: Subject to any disclaimer, the term of this patent is extended or adjusted under 35 U.S.C. 154(b) by 380 days.

(21) Appl. No.: 10/373,503

(22) Filed: Feb. 25, 2003

(65) Prior Publication Data

US 2004/0046721 A1 Mar. 11, 2004

(30) Foreign Application Priority Data

Sep. 11, 2002 (TW) ..... 91120917 A

(51) Int. Cl.
*G09G 5/02* (2006.01)

(52) U.S. Cl. ..... 345/694; 345/39; 345/46; 345/55; 345/83; 348/446; 340/815.45

(58) Field of Classification Search ..... 345/39, 345/46, 55, 56, 82, 102, 694, 696; 348/446; 340/815.45

See application file for complete search history.

(56) References Cited

U.S. PATENT DOCUMENTS 5,559,529 A * 9/1996 Maher ..... 345/613
5,995,070 A 11/1999 Kitada ..... 345/83
6,661,429 B1 * 12/2003 Phan ..... 345/694

* cited by examiner

*Primary Examiner*—Henry N. Tran
(74) *Attorney, Agent, or Firm*—Ladas and Parry LLP

(57) ABSTRACT

The present invention discloses a method for driving a full-color LED display board with high resolution. It features three original color LED pixels that are arranged in a diamond pattern to form LED array, and an interlacing scan circuit is used to control the LED array. As a result, the display of a new pixel can be inserted between two contiguous pixels and the resolution of the full-color LED display board increases.

4 Claims, 5 Drawing Sheets

METHOD FOR DRIVING FULL-COLOR LED DISPLAY BOARD

BACKGROUND OF THE INVENTION (1) Field of the Invention

The present invention relates to a method for driving full-color LED (light emitting diode) display board, and more particularly, to a method for driving full-color LED display board by interlacing scan to increase resolution.

(2) Description of Prior Art

The full-color LED display board has been widely used for displaying pictures and information not only in sports fields and recreation grounds but also outdoor and indoor advertisements.

The full-color LED display board is controlled by a professional drawing software that is executed by a computer to perform diagram treatment of text, diagram and image to generated stereo and motion picture appearance. Additionally, the full-color LED display board can be incorporated with signal processing function of multi-media to connect with AV and S terminals of a camera, video recorder or television, and frames on a monitor of the computer can be displayed in synchronization by an interface with high-speed transmission. Since a full-color LED display board has beautiful colors and abundant variations, people are attracted to what is displayed and the efficiency of advertisement is maximized.

Generally speaking, a full-color LED display board of the prior art includes three units that are a main computer 11, a signal-receiving interface 12, and a driving unit 13, as shown in FIG. 1. The main computer 11 serves to generate motion picture files of text, diagram and image, and these motion picture files are then arranged by time sequence and transmitted to the signal-receiving interface 12 directly or by Internet. The signal-receiving interface 12 is connected to the main computer and serves to store and sort the frames from the main computer 11. The driving unit 13 includes a power supply with a processor to drive LEDs of different colors and different combinations according to a predetermined displaying mode.

FIG. 2 is an image 20 of a displaying frame to be displayed. The image 20 includes a plurality of pixels and is also represented by dots of the x-axis and y-axis. For example, the image 20 may include dots of 640 columns and 480 rows, and may be of higher resolution. Additionally, each pixel of the image 20 consists of red, green and blue color to display a colorful image.

FIG. 3 is a full-color LED display board 30 that consists of a plurality of pixels 31, and each pixel 31 corresponds to a pixel of the image 20 to be displayed. Since the pixel of the image 20 is color-displayed, each pixel 31 has four LED dots 32. The four LED dots 32 are two red LED dots, one green LED dot and one blue LED dot. The brightness and color of a pixel of the image 20 is formed by the combination of the four LED dots 32.

According to the prior art, only a single LED pixel 31 is used to display a pixel of the image 20 to be displayed, where the high quality and high resolution are unsatisfactory and the resolution is limited.

SUMMARY OF THE INVENTION

The primary objective of the present invention is to provide a method for driving full-color LED display board. The present invention uses an interlacing scan technique to apparently increase the resolution of the full-color LED display board without increasing the number of the LEDs.

To achieve the above-mentioned objective, the present invention provides a method for driving full-color LED display board with two-fold resolution. It features three primary color LED pixels that are arranged in a particular pattern to form LED array, and an interlacing scan circuit is used to control the LED array. As a result, a display of new pixels can be inserted between two contiguous pixels and the resolution of the full-color LED display board increases two-fold.

The method for driving full-color LED display board of the present invention is described in the following preferred embodiment, which comprises three steps:

Step (a): providing a full-color LED display board comprising a first LED array having a plurality of LED pixels arranged in a diamond pattern;

Step (b): outputting odd dot signals of odd rows and even dot signals of even rows of an image to be displayed to the first LED array; and Step (c): outputting odd dot signals of even rows and even dot signals of odd rows of the image to a second LED array.

An LED pixel of the second LED array comprises a right LED dot of the left adjacent pixel of the first LED array, a left LED dot of a right adjacent pixel of the first LED array, a bottom LED dot of a top adjacent pixel of the first LED array and a top LED dot of a bottom adjacent pixel of the first LED array.

BRIEF DESCRIPTION OF THE DRAWINGS

The present invention will be described according to the appended drawings in which.

DETAILED DESCRIPTION OF THE INVENTION

Figure 1:
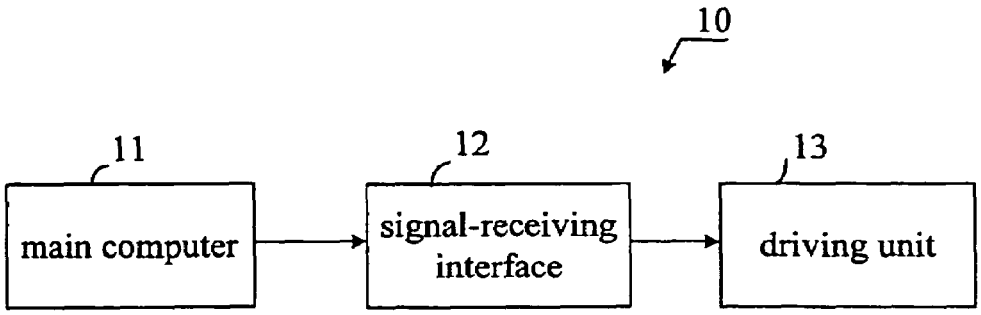
FIG. 1 shows a functional block diagram showing a configuration of a full-color LED display board system according to the prior art.
Figure 4:
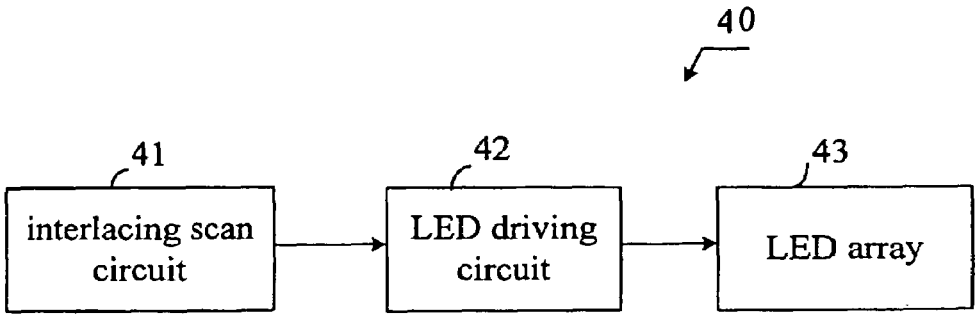
FIG. 4 shows a functional block diagram showing a driving module of full-color LED display board according to the present invention.
Figure 2:
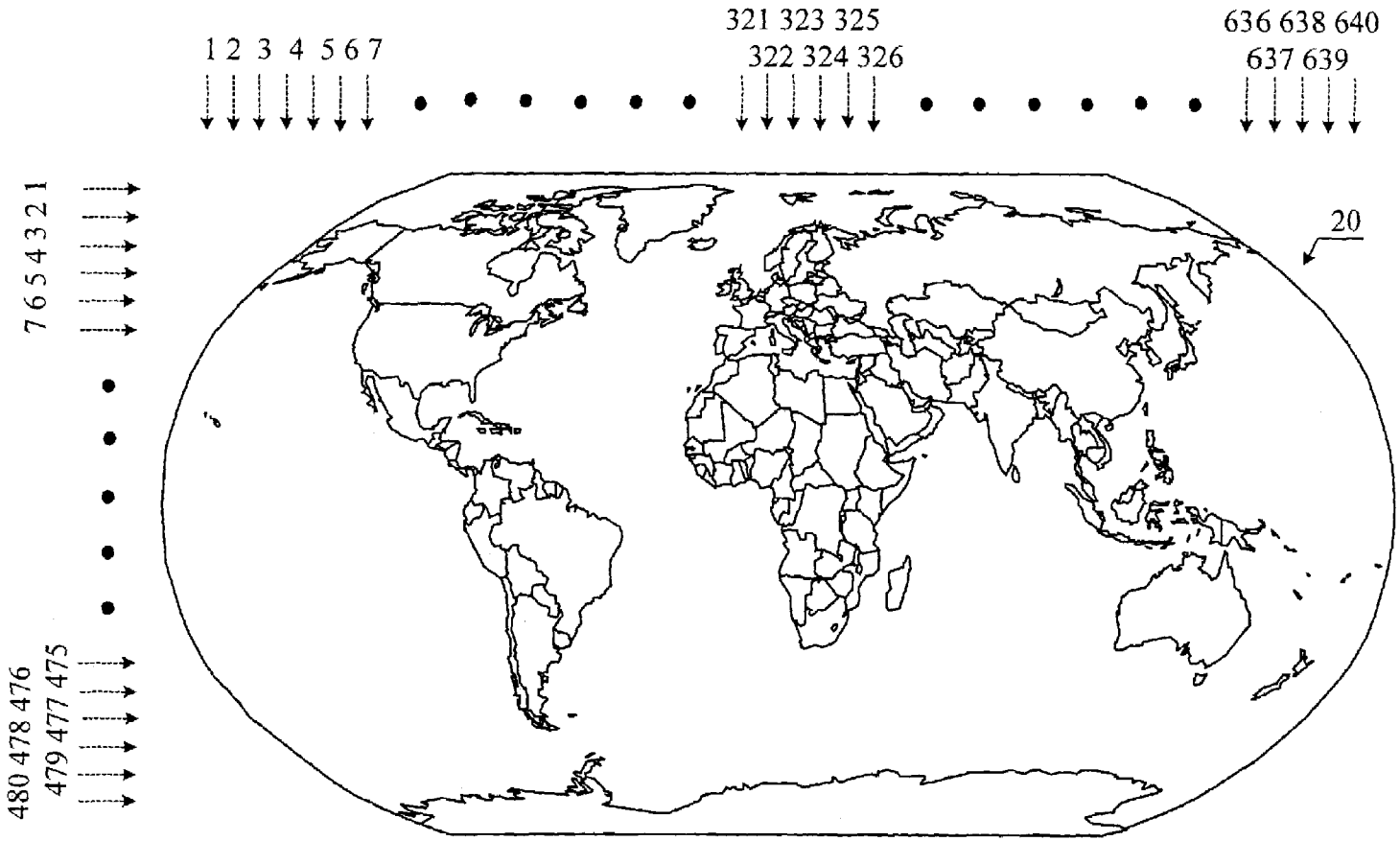
FIG. 2 shows an image to be displayed on full-color LED display board.
Figure 3:
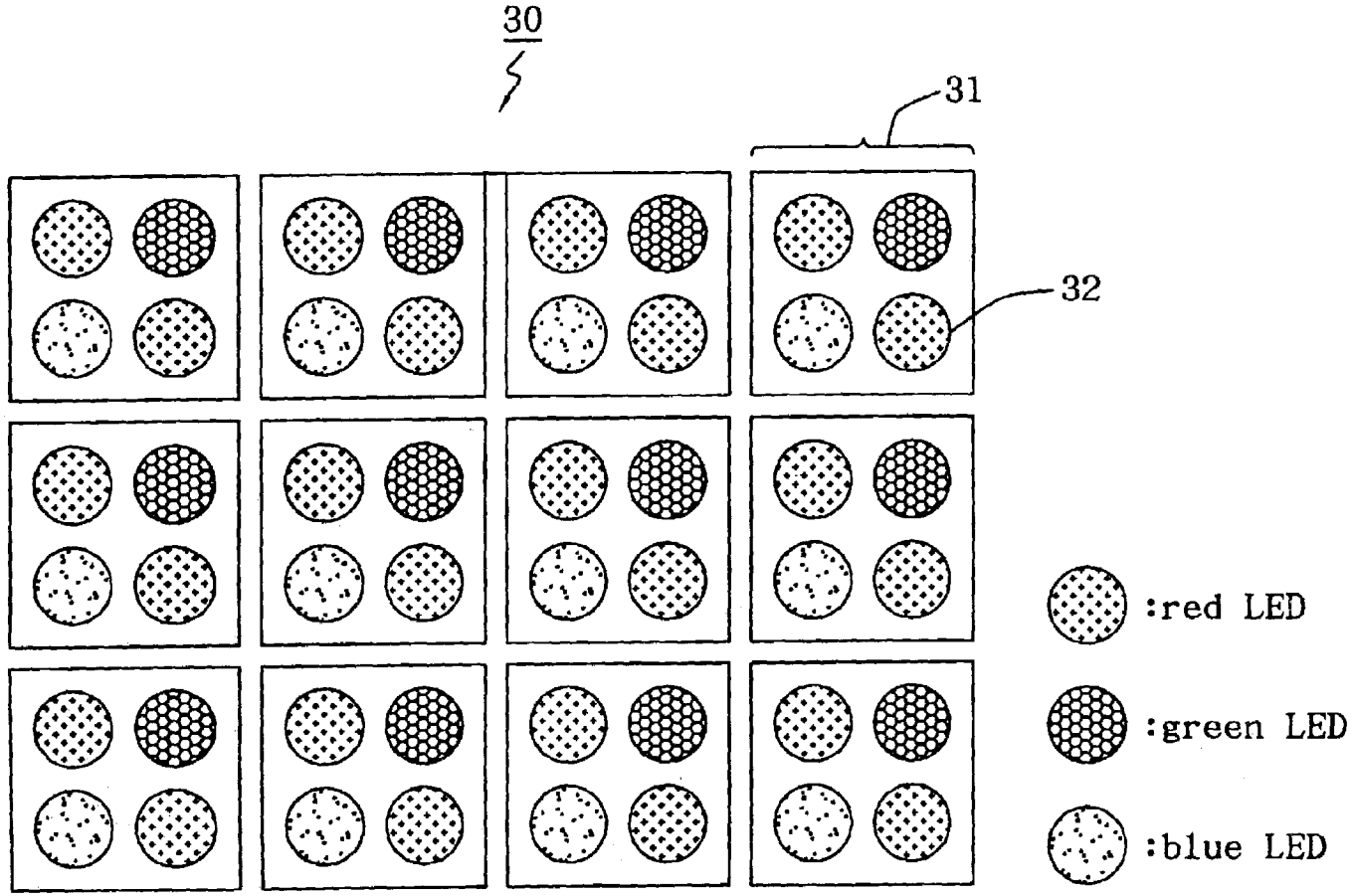
FIG. 3 (Prior Art)
FIG. 3 shows a full-color LED display board according to the prior art.

FIG. 4 shows a functional block diagram showing a driving module 40 of full-color LED display board according to the present invention. The driving module 40 comprises an interlacing scan circuit 41, LED driving circuit 42 and an LED array 43. The interlacing scan circuit 41 serves to display image such as an image 20 in FIG. 2 by shifting one of the dots from one scan to another to increase resolution. The LED circuit 42 is used to drive the LED array 43 to emit light, and features low voltage, low power consumption, long life and fast response. Pixels of the LED array 43 are arranged in a special pattern such as a diamond pattern disclosed in the preferred embodiment of the present invention. The drive module 40 of the present invention uses the interlacing scan circuit 41 to output an image to the LED driving circuit 42, and then the LED driving circuit 42 turns the LED array 43 on to display the image.

Figure 5:
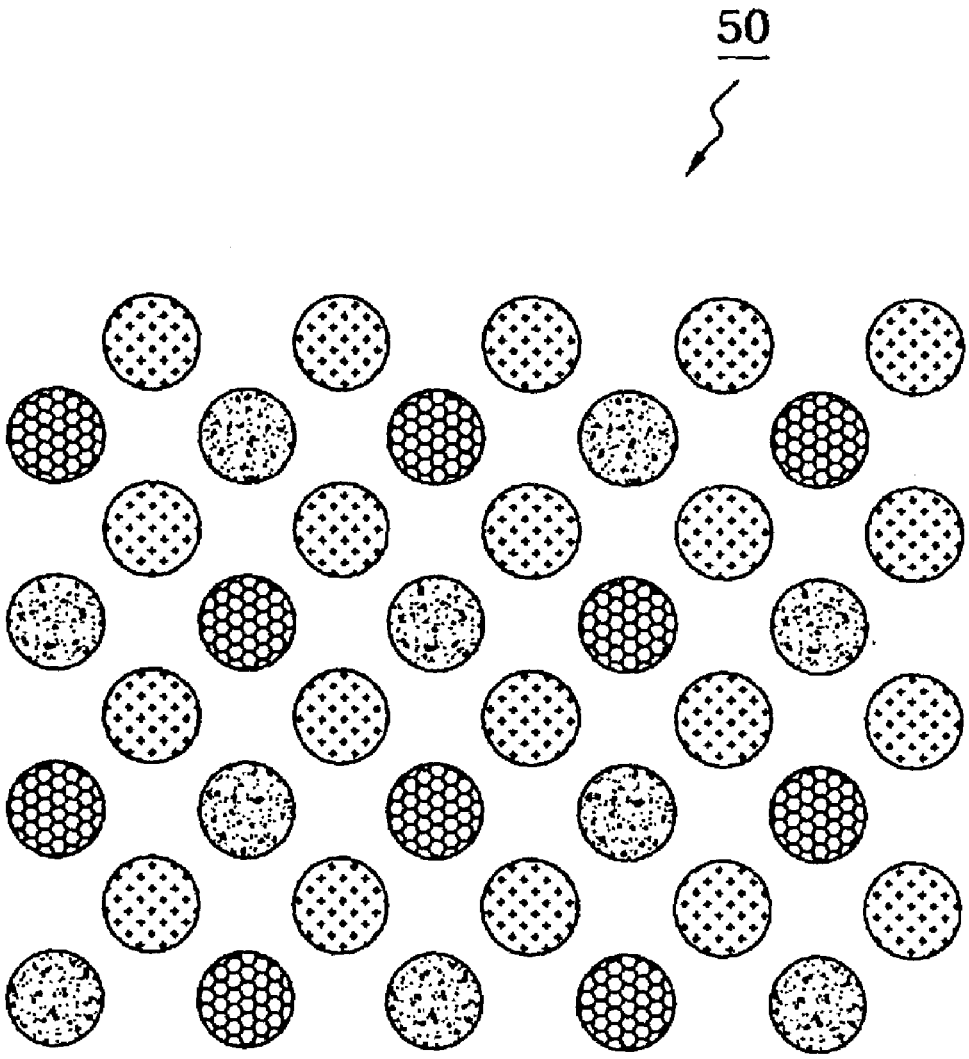
FIG. 5 shows a diagram illustrating the arrangement of a full-color LED display board of a preferred embodiment according to the present invention.

FIG. 5 shows a diagram illustrating the arrangement of a full-color LED display board 50 of a preferred embodiment according to the present invention. The arrangement appears to be in a diamond matrix. The present invention arranges the red, green and blue LEDs at an equidistance and an alternating manner to form LED array, and uses two red LEDs, one green LED and a blue LED arranged in a diamond pattern to form a basic pixel.

Figure 6A:
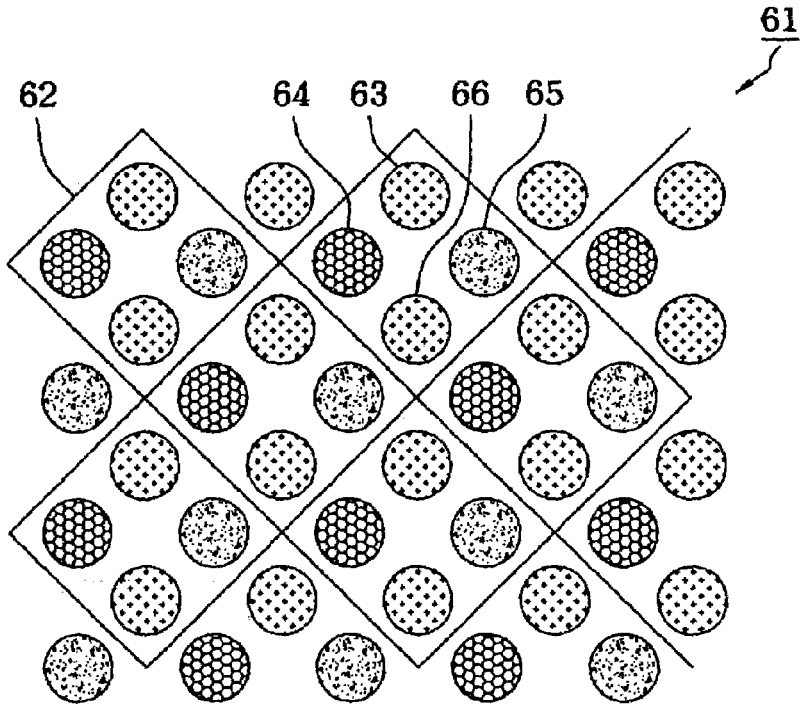
FIGS. 6(*a*) and 6(*b*) show the first and second LED arrays of the interlacing scan according to the present invention.
Figure 6B:
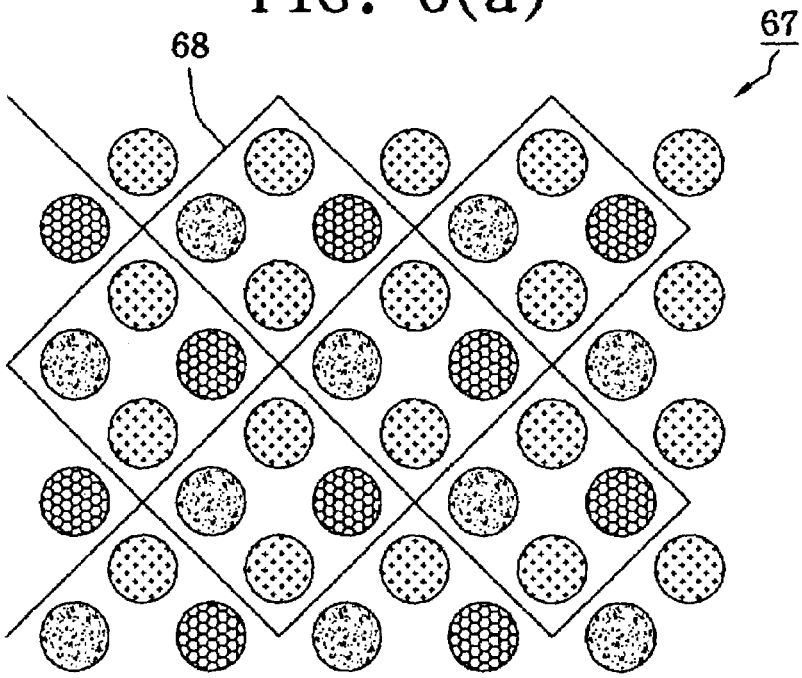

According to the preferred embodiment of the present invention, an image is displayed by two interlacing scan, as shown in FIGS. 6(*a*) and 6(*b*). FIG. 6(*a*) shows the first interlacing scan that outputs even dot signals of even rows and odd dot signals of odd rows of the image to be displayed onto the LED driving circuit 42, and turns the LED array 43 on. At this moment, pixels of LED array 43 are formed and display normally. FIG. 6(*b*) shows the second interlacing scan that outputs even dot signals of odd rows and odd dot signals of even rows of the image to the LED driving circuit 42, and turns the LED array 43 on. At this moment, four most contiguous LED dots of four contiguous LED pixels during the first interlacing scan form a new pixel of the LED array 43, which is the new pixel of the LED array 43 consisting of a right LED dot of a left pixel, a left LED dot of a right pixel, a bottom LED dot of a top pixel and a top LED dot of a bottom pixel of the first LED array, and the left pixel, the right pixel, the top pixel and the bottom pixel are contiguous. The present invention turns on the full-color LED display board as described in FIGS. 6(*a*) and 6(*b*) to increase the resolution two-fold.

The full-color LED display board shown in FIG. 6(*a*) can be treated as a first LED array 61, which has a plurality of first LED pixels 62 arranged in a diamond pattern. Each first LED pixel 62 has a top LED dot 63, a bottom LED dot 66, a left LED dot 64 and a right LED dot 65. The odd dot signals of odd rows and even dot signals of even rows of an image to be displayed are output onto the first LED array 61.

The full-color LED display board shown in FIG. 6(*b*) can be treated as a second LED array 67, which includes a plurality of second LED pixels 68 arranged in a diamond pattern. The second LED pixel 68 has a right LED dot 65 of a left adjacent first LED pixel, a left LED dot 64 of a right adjacent first LED pixel, a bottom LED dot 66 of a top adjacent first LED pixel and a top LED dot 63 of a bottom adjacent first LED pixel. In addition, the odd dot signals of even rows and even dot signals of odd rows of the image are output to the second LED array 67.

While the invention has been described by way of example and in terms of a preferred embodiment, it is to be understood that the invention is not limited to the disclosed embodiment. To the contrary, it is intended to cover various modifications. Therefore, the scope of the appended claims should be accorded the broadest interpretation so as to encompass all such modifications.

What is claimed is:

1. A method for driving a full-color LED display board with high resolution, comprising the steps of:

providing a full-color LED display board including a first LED array, wherein the first LED array has a plurality of first LED pixels arranged in a diamond pattern, and each first LED pixel has a top LED dot, a bottom LED dot, a left LED dot and a right LED dot;

outputting odd dot signals of odd rows and even dot signals of even rows of an image to be displayed onto the first LED array; and outputting odd dot signals of even rows and even dot signals of odd rows of the image to a second LED array, wherein the second LED array includes a plurality of second LED pixels arranged in a diamond pattern, each second LED pixel has a right LED dot of a left adjacent first LED pixel, a left LED dot of a right adjacent first LED pixel, a bottom LED dot of a top adjacent first LED pixel and a top LED dot of a bottom adjacent first LED pixel.

2. The method of claim 1, wherein an interlacing scanning circuit outputs the image to be displayed onto an LED driving circuit to drive the first and second LED arrays to emit light.

3. The method of claim 1, wherein each pixel of the first and second LED arrays comprises two red LED dots, one green LED dot and one blue LED dot.

4. The method of claim 3 wherein the red LED dots are arranged at top and bottom of the diamond shaped pixel and the green and blue dots are arranged at sides of the diamond shaped pixel.

* * * * *